US011439282B2

(12) United States Patent
Bussell

(10) Patent No.: US 11,439,282 B2
(45) Date of Patent: Sep. 13, 2022

(54) EXTENSIBLE SQUEEZEE WITH REVERSIBLE BLADE

(71) Applicant: Jeffrey A. Bussell, West Bloomfield, MI (US)

(72) Inventor: Jeffrey A. Bussell, West Bloomfield, MI (US)

( * ) Notice: Subject to any disclaimer, the term of this patent is extended or adjusted under 35 U.S.C. 154(b) by 446 days.

(21) Appl. No.: 16/785,829

(22) Filed: Feb. 10, 2020

(65) Prior Publication Data

US 2020/0253433 A1 Aug. 13, 2020

Related U.S. Application Data

(60) Provisional application No. 62/803,653, filed on Feb. 11, 2019.

(51) Int. Cl.

| | |
|---|---|
| ***A47L 13/11*** | (2006.01) |
| ***A47L 1/06*** | (2006.01) |
| ***B25G 3/38*** | (2006.01) |
| ***B25G 1/04*** | (2006.01) |

(52) U.S. Cl.

CPC ..... *A47L 1/06* (2013.01); *A47L 13/11* (2013.01); *B25G 1/04* (2013.01); *B25G 3/38* (2013.01)

(58) Field of Classification Search

CPC .. A47L 13/11; A47L 1/06; B25G 1/04; B25G 3/28

See application file for complete search history.

(56) References Cited

U.S. PATENT DOCUMENTS

| | | | | |
|---|---|---|---|---|
| 742,590 | A * | 10/1903 | Cattelle | A47L 1/06 403/92 |
| 6,155,620 | A * | 12/2000 | Armstrong | A01B 1/00 294/7 |
| 7,000,282 | B2 * | 2/2006 | Cox | B25G 1/06 15/245 |
| 9,775,486 | B2 * | 10/2017 | Dotterman | A47L 13/44 |
| 10,093,281 | B2 | 10/2018 | Vande Vyvere | |
| 2009/0049636 | A1 * | 2/2009 | Bae | A47L 1/08 15/245 |
| 2011/0173768 | A1 | 7/2011 | Donato | |
| 2012/0174332 | A1 | 7/2012 | Patterson et al. | |
| 2018/0297190 | A1 | 10/2018 | Vande Vyvere | |

FOREIGN PATENT DOCUMENTS

| | | |
|---|---|---|
| EP | 2359728 A2 | 8/2011 |
| EP | 3257415 B1 | 1/2019 |

* cited by examiner

*Primary Examiner* — Shay Karls
(74) *Attorney, Agent, or Firm* — Dinsmore & Shohl LLP

(57) ABSTRACT

An adjustable hand-held squeegee device with reverse angle head adjustment. An elongated handle can include either a single elongated member or any plurality of members configured in telescoping fashion. A head includes a rotatable base portion supported at a forward end of the handle. A spring biased locking mechanism is integrated into the handle in proximity to the rotatable base and includes a forward projection engaging a first recess of the rotatable base in a first position. Upon retracting the mechanism via a projecting trigger portion, the rotatable base is rotated to align a second circumferentially offset recess so that, and upon releasing the trigger, the squeegee head is oriented in a reverse angular fashion relative to the handle.

8 Claims, 6 Drawing Sheets

EXTENSIBLE SQUEEZEE WITH REVERSIBLE BLADE

CROSS REFERENCE TO RELATED APPLICATIONS

The present application claims the priority of U.S. Ser. No. 62/803,653 filed Feb. 11, 2019.

FIELD OF THE INVENTION

The present invention relates generally to squeegee or wiper style devices for various uses. More specifically, the present invention teaches a telescoping and reverse-angle adjustable squeegee for use by individuals, in particular when cleaning or wiping a lower surface and without the necessity of having to stoop or kneel.

BACKGROUND OF THE INVENTION

The prior art is documented with various types of squeegee or cleaning devices. A first example of this is shown in Donato (US 2011/0173768) which discloses a squeegee having a handle with a resilient blade set at an angle less than ninety degrees of the angle formed between the handle and the point of the blade's attachment. This configuration allows the squeegee to work with gravity by preventing the newly cleaned surface from being fouled by used cleaning solution. As further disclosed, and when used with a tilt window, the squeegee pushes the cleaning solution down the tilted surface and with gravity to leave a clean dry surface.

Also noted is the swivel squeegee handle design of Bae US 2009/0049636. The wiper design of EP 2 359 728 to Moerman NV, teaches a floor squeegee which includes a body and a manually coupled rubber blade holder which is also linearly displaceable between positions along a longitudinal direction of the blade holder.

SUMMARY OF THE PRESENT INVENTION

The present invention discloses an adjustable hand-held squeegee device with reverse angle head adjustment. An elongated handle can include either a single elongated member or any plurality of members configured in telescoping fashion. A squeegee head includes a rotatable base portion supported at a forward end of the handle.

A spring loaded locking mechanism is integrated into the handle in proximity to the rotatable base and includes a forward projection engaging a first recess of the rotatable base in a first position. Upon retracting the locking mechanism via an integrally formed and projecting trigger portion, the rotatable base is rotated to align a second circumferentially offset recess so that, and upon releasing the trigger, the squeegee head is oriented in a reverse angular fashion relative to the handle.

Additional features include a width extending and flexible blade attached to the width extending and pivotally supported head assembly. The handle further comprising multiple inter-telescoping sections for adjusting between varying overall lengths. Other features include the head, neck and handle being constructed of durable material not limited to plastic or aluminum. Yet additional features include the ability to pivotally adjust the blade according to a non-limiting range of 110° to 180° between the first and second orienting positions.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to the attached figures, the present invention teaches a telescoping and reverse-angle adjustable squeegee, generally at 10, for use by individuals, in particular when cleaning or wiping a lower surface of a window, glass shower enclosure, or the like, and without the individual having to stoop or kneel. Without limitation, this includes cleaning of a solution for a glass or other surface as well as wiping or clearing water buildup.

As will be further described in reference to the following illustrations, this is accomplished (according to the non-limiting and illustrated embodiment) by permitting the width extending head to be reverse angle adjusted, such as via a pivotal neck connection and in order to permit the user to exert a reverse direction (i.e. upward) motion to the device, this occurring such as in combination with extending the handle from the collapsed to extended positions.

Figure 1:
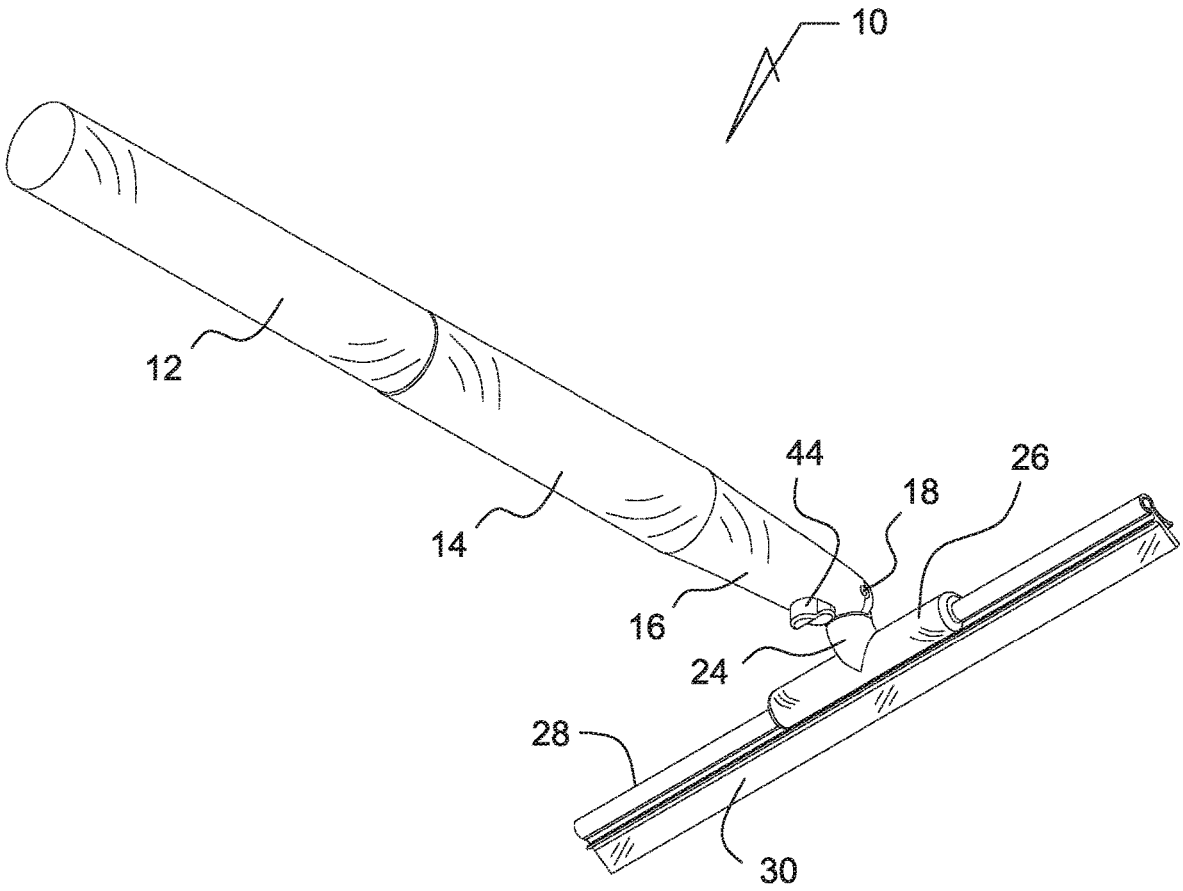
FIG. 1 is a perspective view of the angularly adjustable squeegee depicted in a first wiping position according to the present invention.
Figure 2:
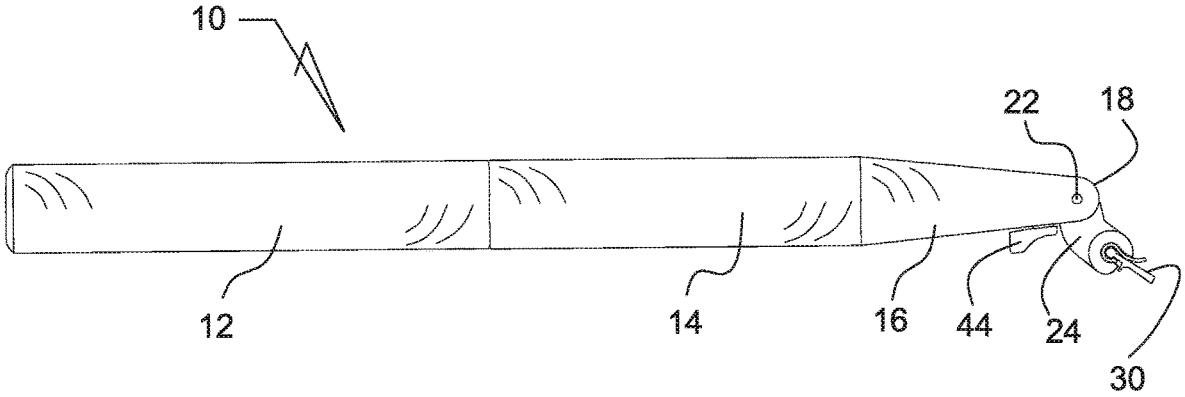
FIG. 2 is a side plan view of the adjustable squeegee in the position of FIG. 1 and depicted in a telescopically collapsed position.
Figure 3:
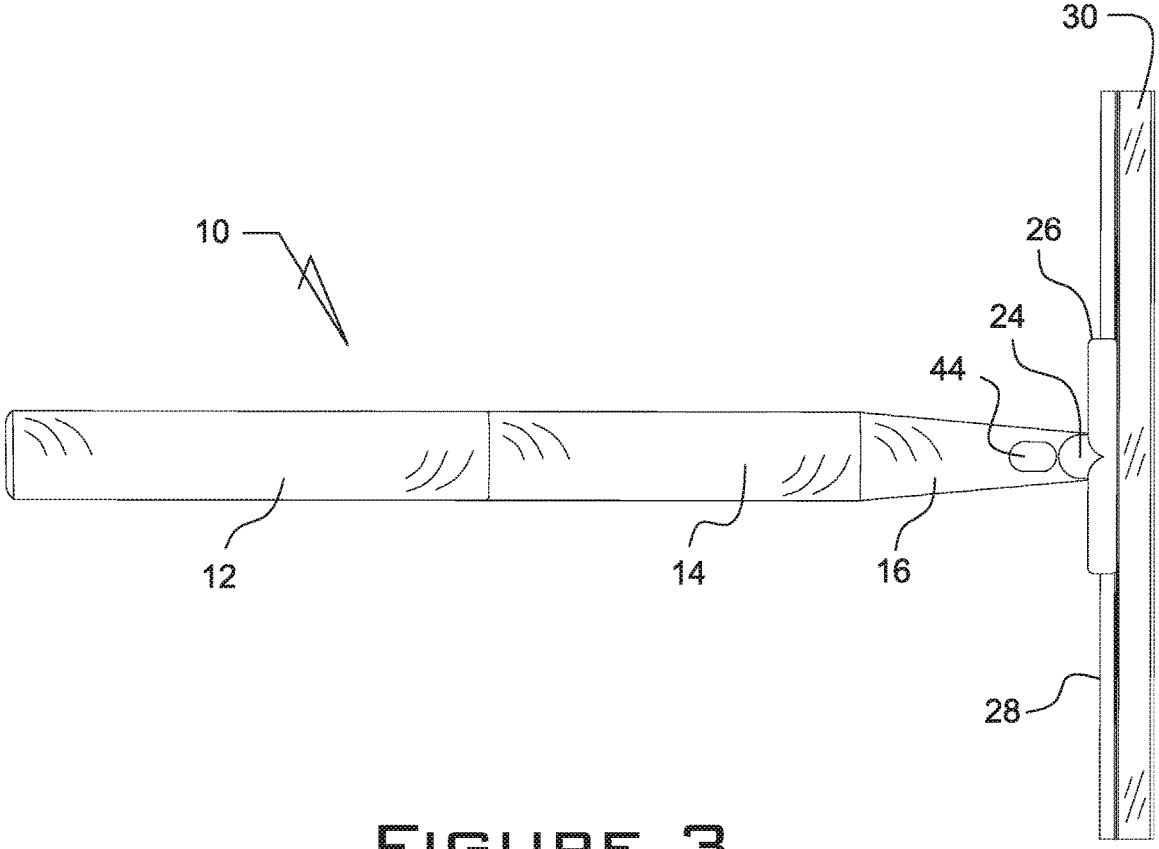
FIG. 3 is a bottom plan view of the squeegee in FIG. 2.

FIG. 1 is a perspective view of the angularly adjustable squeegee, again at 10, depicted in a first wiping position according to the present invention, with FIGS. 2 and 3 depicting each of side and rotated bottom plan views of the squeegee device. The squeegee can include a singular handle or, as shown, may incorporate any plurality of telescopic interconnected portions, shown at 12 and 14. Without limitation, the handle portions are length inter-adjustable and subsequently lockable in any known fashion including providing twist to tighten and counter twist to loosen features incorporated into opposing circumferential surfaces established between the coaxially arranged and inner/outer diameter seating handle portions. Other length adjustment aspects can include, without limitation, substituting through the incorporation of a spring loaded tab (not shown) which can be provided in a given telescoping portion and which seats within any of a plurality of axially spaced slots (also not shown) configured in the overlapping other telescoping portion.

Without limitation, the handle and other structural components of the device can be constructed of any of a lightweight metal such as an aluminum and/or can be constructed of a durable plastic or other suitable material. As further shown in FIG. 11, the outer handle portion can include a textured grip or cladding (see assembleable halves at 11 and 13) which are mounted to the end most positioned telescoping handle portion 12 (this depicted in non-limiting fashion by seating collars 15 for the split halves which seat within end apertures 17 of the outer handle portion 12).

The handle includes a narrowing (or tapered) upper most mounted handle portion, depicted at 16 and which is either integrally formed or otherwise secured to an end of the telescoping handle portion 14 and narrowing in end-most profile at 18. A width extending squeegee head is mounted to the tapered end portion 16 and includes a rotatable base portion 22 supported at a tip of the handle end portion 16 via a pivot pin 25 (this best depicted in FIG. 4 et seq. as well as in the exploded perspective of FIG. 11).

A contoured neck 24 extends from the base portion 22 and to which is secured a width-extending structural support 26 of the head, this in turn including a further width extending rigid support 28 approximating in overall lateral dimension an attachable rubberized flex squeegee blade 30, the elongated blade further including an enlarged base 32 (see FIG. 4 et seq. as well as exploded view of FIG. 11) which is slidably disposed in a laterally installing fashion within an open end location of the recess channel 34 configured at the end of the pivotally adjustable neck 24. The squeegee blade, without limitation, further includes any type of rubberized, silicone or other suitable water redirecting element.

As further shown, the recess channel 34 can seat the reinforcing support 28 for the flex blade 30 which can include an arcuate shape and cross sectional profile 36 which is rounded at an inner end defining the recess channel for mounting the flex blade 30. The profile 36 is further contoured at its outer end (terminating at 38) to provide additional end backing support to the flex blade 30, when the same is bent during normal usage and to prevent the blade from over-bending to an excessive degree during use in order to extend its useful life.

Figure 4:
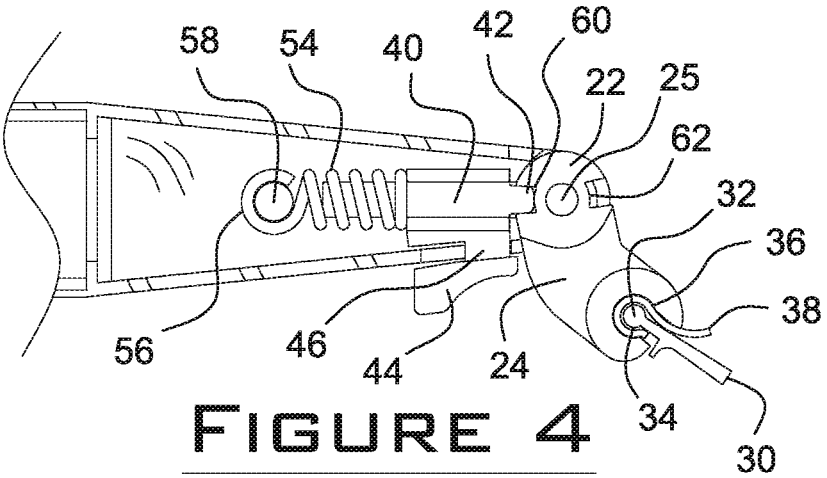
FIG. 4 is a partial cutaway of a head assembly portion of the squeegee as shown in the plan view of FIG. 2 and depicting the spring biased trigger mechanism with forward projection engaging a rotatably mounted base portion of the squeegee head incorporated into the forward neck end of the handle.

Referring further FIG. 4 et seq., a series of partial cutaway views are shown of a head assembly portion of the squeegee, this also shown in the plan view of FIG. 2 and depicting a spring biased squeegee head locking mechanism 40 with forward projection 42 engaging the rotatably mounted base portion 22 of the squeegee head incorporated into the forward neck end 24 of the handle. The locking mechanism 40 includes a lower projecting trigger portion 44 which interconnects, via a narrowed neck 46, with the interior spring loaded locking mechanism 40.

Figure 5:
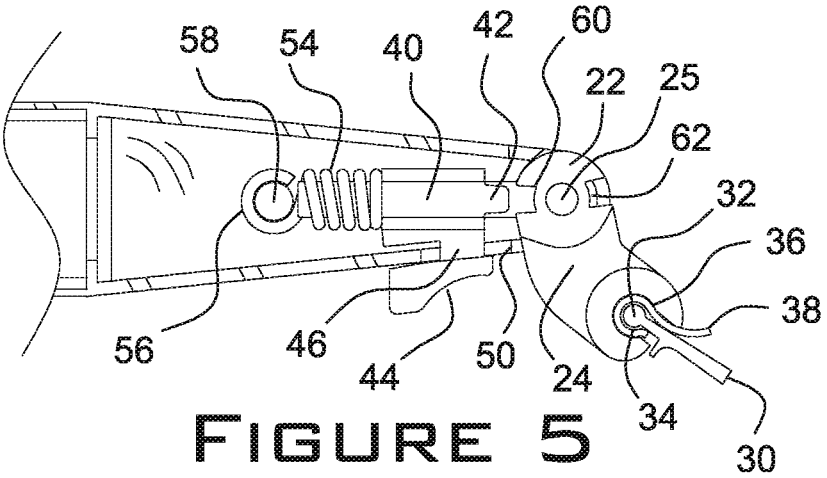
FIG. 5 is a succeeding view to FIG. 4 depicting the forward projecting end of the spring biased trigger mechanism retracted from a first recessed engagement location configured within the rotatably mounted base portion and associated with the position of FIGS. 1-4.

As depicted in FIG. 4 et seq., the narrowed neck 46 seats within a slot configured in the forward end portion 16 of the handle, this further depicted by end surfaces 48 and 50 in FIG. 5 and within which the trigger 44 is displaceable between the engaged position of FIG. 4 and the retracted and disengaged position of FIG. 5. The displaceable locking mechanism includes a rear directed stem 52 (see FIG. 11) which seats within a coil spring 54.

The coil spring 54 also includes a curled end portion 56 which, upon assembly of the split halves (at 16') of the forward handle portion causes an interior projecting collar 58 to seat through the curled end portion 56 of the spring 54. In this manner, the spring 54 biases the locking mechanism in order to cause the forward projecting portion 42 to be biased forwardly into contact with the rotatable base portion 22 of the squeegee head and in order to engage the rotatable portion 22 between each of a first circumferentially disposed recessed pocket 60 and a second offset recess 62, these in turn defining first and second offset orientation positions of the squeegee head.

Figure 6:
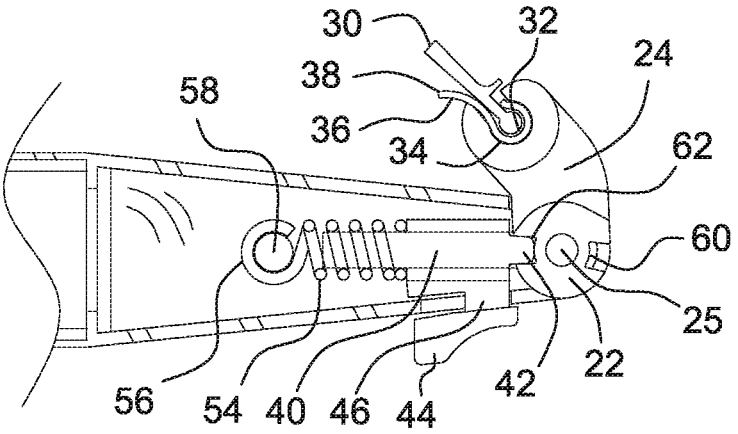
FIG. 6 is a succeeding rotatably adjusted and reverse angled position of the squeegee head with spring biased trigger mechanism being reset into engagement with a second circumferentially offset recessed engagement location.

FIG. 5 is a succeeding view to FIG. 4 depicting the forward projecting end 42 of the spring biased trigger or locking mechanism retracted from the first recessed engagement location (see again defined recess pocket 60) configured within the rotatably mounted base portion 22 and associated with the position of FIGS. 1-4. FIG. 6 is a succeeding rotatably adjusted and reverse angled position of the squeegee head (such being manipulated by the user once the forward engaging portion of the locking mechanism is retracted) with the spring biased trigger or locking mechanism being subsequently released to reset into engagement with the second circumferentially offset recessed engagement location or pocket 62.

Figure 11:
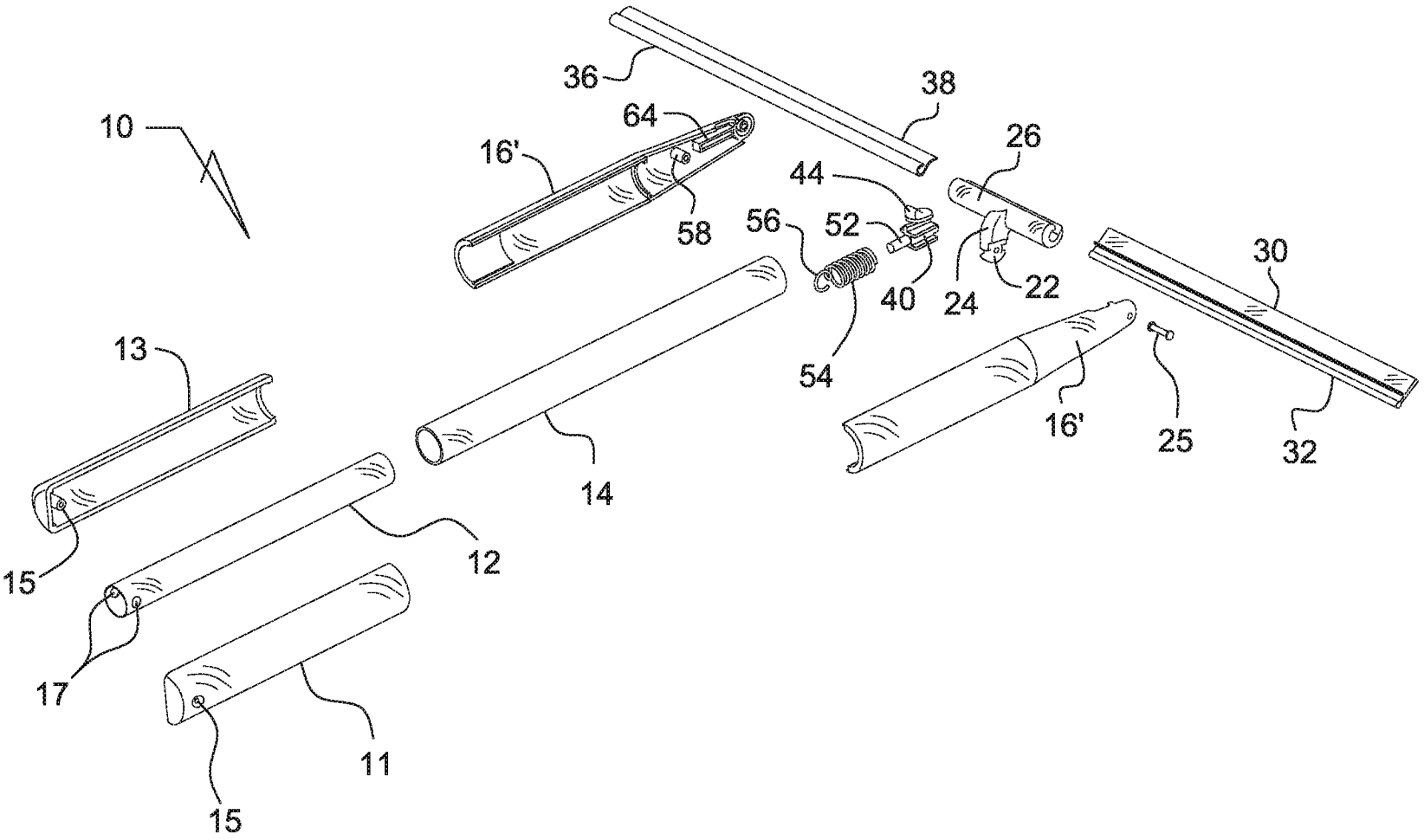
FIG. 11 is an exploded part perspective of the squeegee.

As depicted in FIG. 11, the forward interior end of the squeegee supporting handle portion 16 can include an interior guide or track configuration (see at 64) which operates to seat opposite laterally projecting ledges of the axially displaceable locking mechanism 40 and to define a limited range of displacement of the locking mechanism 40 between the rearwardly retracted and forward engaged positions.

Figure 7:
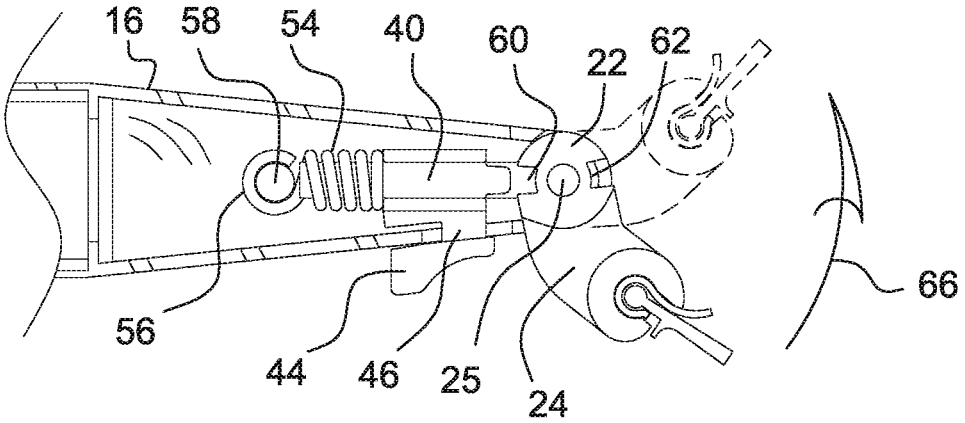
FIG. 7 depicts an initial rotatable adjustment motion of the squeegee head between the positions of FIGS. 5 and 6.
Figure 8:
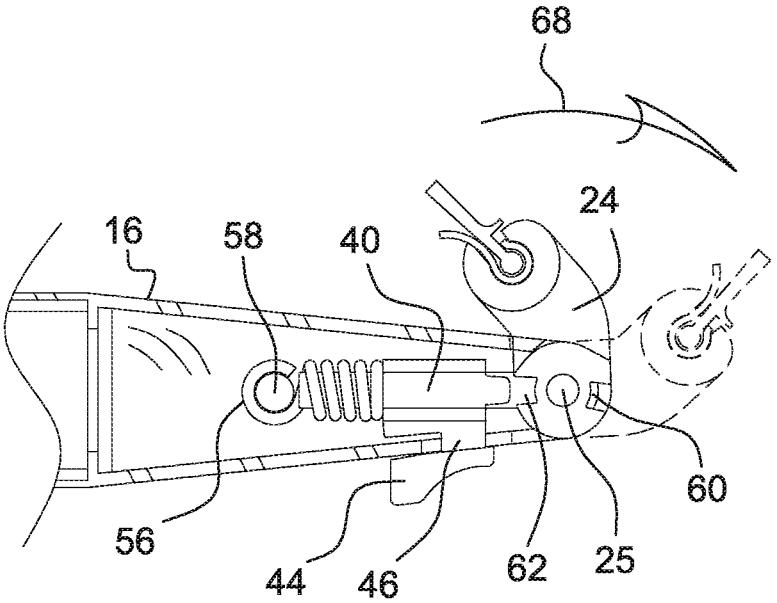
FIG. 8 depicts an initial reverse rotatable adjustment motion of the squeegee head as shown in FIG. 7.

FIG. 7 depicts an initial rotatable adjustment motion of the squeegee head between the positions of FIGS. 5 and 6, see counter clockwise directional arrow 66, with FIG. 8 depicting a reverse rotatable adjustment motion, see clockwise directional arrow 68, of the squeegee head as shown in FIG. 7. The cutaway illustrations shown depict a pair of receiving pockets 60/62 which are arranged at any rotational offset arrangement however which, in one non-limiting application, can be provided at 110-180 degree rotational offset corresponding to the defined first and second positions of the squeegee head, it being understood that the rotatable base portion 22 can alternately include any number of circumferentially offset adjustable positions and beyond the pair depicted at 60 and 62.

Figure 9:
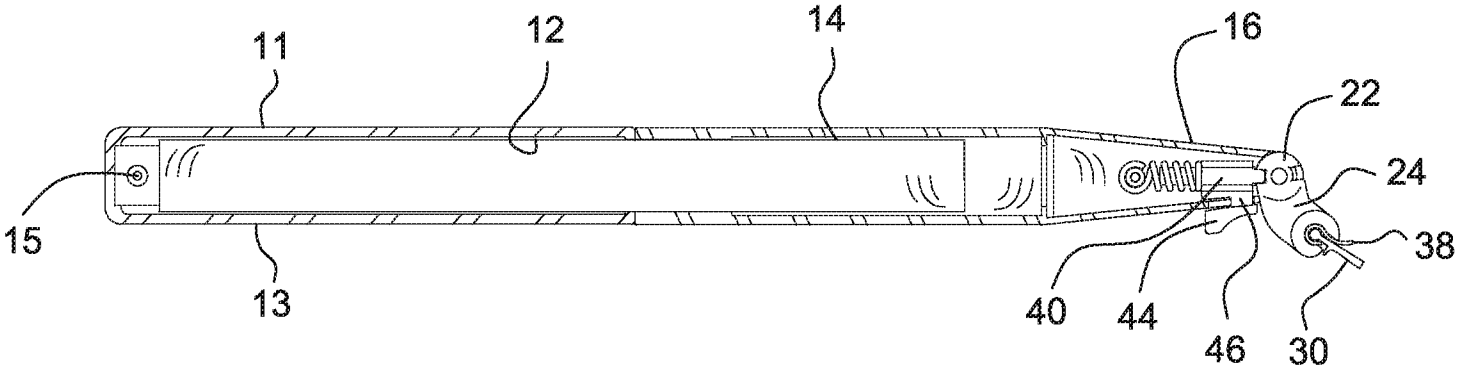
FIG. 9 is an assembled and linear cutaway view of the squeegee handle in the collapsed position of FIG. 2.
Figure 10:
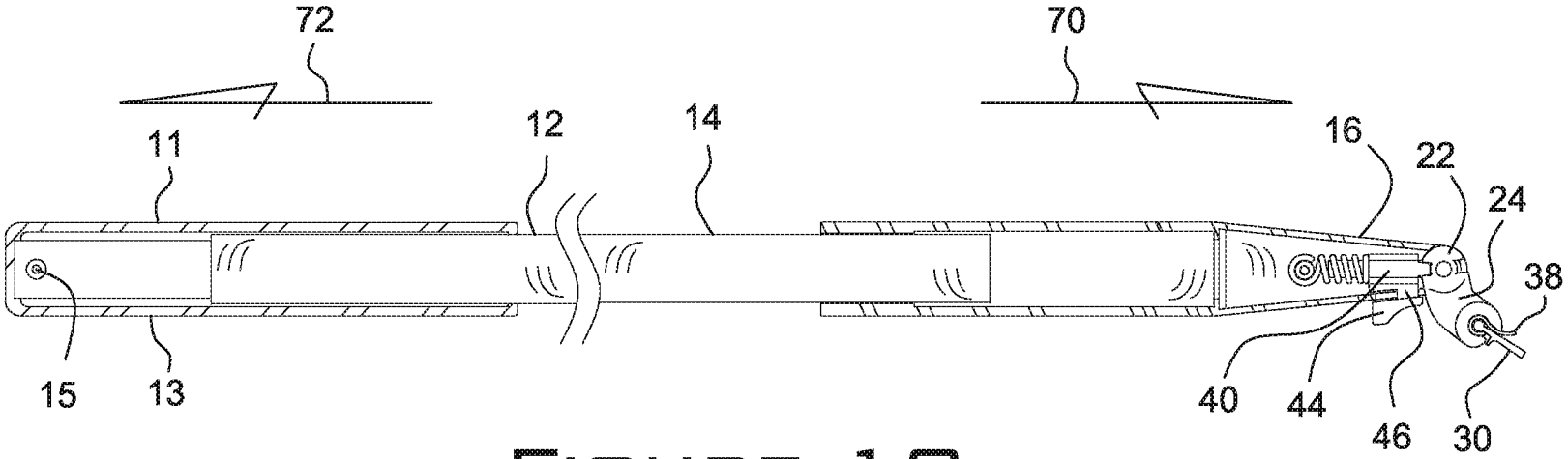
FIG. 10 is a corresponding view to FIG. 9 shown the squeegee handle adjusted to a linearly extended position.

FIG. 9 is an assembled and linear cutaway view of the squeegee handle in the collapsed position of FIG. 2, with FIG. 10 depicting a corresponding view to FIG. 9 and showing the squeegee handle adjusted to a linearly extended position (see further axial directional arrows 70 and 72). As previously noted, the range of adjustment of the telescoping portions can be modified based on either or both the dimensioning of each elongated handle section 12/14 and/or the adjustment mechanism selected to provide for inter-adjustment of the handle portions.

Without limitation, the rotational adjustment mechanism described can be substituted by other structure in order to pivotally readjust the head and blade to any angled desired. It is also envisioned that other articulating and/or universally adjusting structure can be integrated to achieving any desired blade orientation in support of the proposition of being able to first exert a downward stroke of a squeegee head and blade in a first orientation, following which the blade angle is adjusted to a second orientation prior to a executing a second reverse directed upward stroke, all while the user can remain in a standing (non-keeling or stopping) position.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings are have been described in detail, various alternative designs and embodiments exist for practicing the disclosure defined in the appended claims.

I claim:

1. An adjustable hand-held squeegee device with reverse angle adjustment, comprising:

an elongated handle;

a head having a rotatably supported base portion supported by a crosswise interior extending pivot pin located at a forward end of said handle, said head including an extending neck and an end supporting a width extending blade;

an axially displaceable locking mechanism integrated into said handle in proximity to said rotatably supported base and including a forward projection engaging a first circumferentially positioned recess of said rotatable base to establish a first orienting position of said head and blade;

an interior extending collar in said handle supporting a first curled end portion of a coil spring for biasing said locking mechanism into engagement within said first recess;

said locking mechanism including a trigger portion extending through a slot in said handle; and upon retracting said locking mechanism via retraction of said trigger portion against said bias exerted by said spring, said forward projection retracting from said first recess, said rotatable base being rotated to align with a second circumferentially offset recess so that, and upon releasing the trigger, said forward projection of said locking mechanism engaging said second recess so that said head is oriented in a second and reverse angular position relative to the handle.

2. The device as described in claim 1, said handle further comprising plurality of telescopic interconnected portions for adjusting between varying overall lengths.

3. The device as described in claim 1, at least one of said head, neck and handle being constructed of durable material not limited to a plastic or aluminum.

4. The device as described in claim 1, further comprising an angle of pivotal adjustment of said blade according to a range of 110° to 180° between said first and second orienting positions.

5. The device as described in claim 1, said head further comprising a width extending rigid support approximating in overall lateral dimension of said blade.

6. The device as described in claim 5, said width extending elongated blade further comprising an enlarged base slidably disposed in a laterally installing fashion within a recess channel configured at the end of said head.

7. The device as described in claim 6, further comprising said recess channel having an arcuate shape and cross sectional profile which is rounded at an inner end for mounting said blade, said profile is further contoured at its outer end to provide additional end backing support to said blade when the same is bent during normal usage and to prevent said blade from over-bending to an excessive degree during use.

8. The device as described in claim 1, said opening in said handle further comprising a slot configured along a forward end of said handle and along which said trigger is displaceable for manipulating said locking mechanism between engaged and disengaged positions with said rotatable base portion.

* * * * *